US007337906B2

(12) United States Patent
Chang

(10) Patent No.: US 7,337,906 B2
(45) Date of Patent: Mar. 4, 2008

(54) PHARMACEUTICAL TREATMENT BLISTER CARD

(75) Inventor: Ching Yi Chang, Stockton, NJ (US)

(73) Assignee: Merck & Co., Inc., Rahway, NJ (US)

( * ) Notice: Subject to any disclaimer, the term of this patent is extended or adjusted under 35 U.S.C. 154(b) by 449 days.

(21) Appl. No.: 10/506,399

(22) PCT Filed: Mar. 3, 2003

(86) PCT No.: PCT/US03/06313

§ 371 (c)(1),
(2), (4) Date: Sep. 1, 2004

(87) PCT Pub. No.: WO03/076303

PCT Pub. Date: Sep. 18, 2003

(65) Prior Publication Data

US 2005/0178692 A1 Aug. 18, 2005

Related U.S. Application Data

(60) Provisional application No. 60/362,495, filed on Mar. 7, 2002.

(51) Int. Cl.
*B65D 83/04* (2006.01)

(52) U.S. Cl. ..... 206/531; 206/538

(58) Field of Classification Search ..... 206/528, 206/531–532, 534.1, 538, 484, 807, 813, 206/820, 462, 467, 460, 461
See application file for complete search history.

(56) References Cited

U.S. PATENT DOCUMENTS 3,912,082 A 10/1975 Gerner et al.
4,011,949 A 3/1977 Braber et al.
4,125,190 A 11/1978 Davie, Jr. et al.
4,752,033 A 6/1988 Groendyke
5,088,603 A 2/1992 Kirkpatrick
5,172,812 A 12/1992 Wharton et al.
5,758,774 A 6/1998 Leblong
5,775,505 A 7/1998 Vasquez et al.
5,915,559 A 6/1999 Hulick et al.
5,927,500 A 7/1999 Godfrey et al.
6,048,580 A * 4/2000 Carter et al. ..... 427/407.1
6,155,414 A 12/2000 Vaessen
6,155,423 A 12/2000 Katzner et al.
6,679,382 B1 * 1/2004 Kancsar et al. ..... 206/531
6,896,139 B2 * 5/2005 Kancsar et al. ..... 206/531
6,951,282 B2 * 10/2005 Jones ..... 206/469
7,000,768 B2 * 2/2006 Morita et al. ..... 206/531

* cited by examiner

*Primary Examiner*—Shian T. Luong
(74) *Attorney, Agent, or Firm*—Particia A. Shatynski; Valeria J. Camara

(57) ABSTRACT

A multifold, pharmaceutical treatment blister card (10) suitable for dispensing unit dosages of a pharmaceutical composition (80). The multifold card (10) may be further characterized as a two layer card section containing blister cavities (22) there between, wherein a security strip (32) is located between the cavities and one of the layers, and wherein the security strip must be removed prior to dislodging the pharmaceutical composition from the card.

41 Claims, 6 Drawing Sheets

SECTION A–A

PHARMACEUTICAL TREATMENT BLISTER CARD

RELATED APPLICATION

This application is claims the benefit of provisional application U.S. Ser. No. 60/362,495, filed Mar. 7, 2002.

FIELD OF THE INVENTION

The present invention relates to a child resistant, pharmaceutical treatment blister card suitable for incorporation of literature in the form of dosing schedules, safety information, etc. relating to a pharmaceutical composition stored within the card for dispensing by a patient. More particularly, the invention relates to a child resistant blister card section characterized by a safety strip incorporated into the card that must be withdrawn therefrom prior to removal of the pharmaceutical composition. Particular preferred embodiments, including bi-fold and tri-fold cards are further described herein.

BACKGROUND OF THE INVENTION

Many forms of dispensing containers and storage vessels for pharmaceutical compositions have been introduced to the market in recent years. Pharmaceutical compositions, particularly those in the form of pre-measured tablets, pills, powders and capsules have been dispensed from vials, bottles, or blister packages.

More recently, blister packages have been designed to be child resistant. That is, the packages have been designed to be particularly resistant to opening by younger children yet manageable for an adult. In many cases, multiple steps must be performed in sequence to open a child safety blister package. Another convenience of a child safety, blister package is that individual dosages of a composition may be separately sealed in blister cavities, wherein each individual cavity has the child safety feature. After administration of a dosage of a composition, the empty portion of the blister cavity may be removed from remain cavities and disposed.

Along with instructions and scheduling information that may be included in the pharmaceutical treatment card, the blister package may serve as an aid for self-administration of a composition as prescribed. See U.S. Pat. Nos. 3,912,082; 4,011,949; 4,125,190; 5,088,603; 5,172,812; 5,758,774; 6,155,414; 4,752,003; 6,155,423; and 5,915,559.

Presently, there is a need for a more child resistant blister package, perhaps incorporated into a pharmaceutical treatment card. Generally, the child resistant, blister package must present difficult for young children, e.g. ranging of about 27 to about 60 months of age, to open. At the same time, the pharmaceutical treatment blister card should present no difficulty for adults to open. A pharmaceutical treatment card incorporating a blister package may provide useful instruction, information and advertising space for the manufacturer of a pharmaceutical composition contained therein.

U.S. Pat. No. 5,927,500 to Godfrey et al., issued Jul. 27, 1999 suggest a pharmaceutical containment package characterized by cover and backing layers constructed of a reinforcing fabric substrate having a blister card disposed there between. However, Godfrey et al. fails to provide a child resistant blister within the package. Generally, an individual dosage of a pharmaceutical composition may be pushed through a perforated backing conforming to the general shape of the dosage.

U.S. Pat. No. 5,775,505 to Hofmann et al., issued Aug. 26, 1998 teaches a childproof, blister package, characterized as a multiple layer assembly, having a 2×3 array of individually sealed, blister cavities with vertical and horizontal, perforation lines for separating each blister pack. At the intersections of vertical and horizontal perforation lines, there are cavities wherein the layers thereunder are unsealed. Separation of a section of the package produces a pull-tab from the unsealed area, wherein pulling the tab separates the layer from the blister cavity to expose a pill.

PCT publication WO 97/02192, published Mar. 16, 1999 suggest a multiple layer blister pack having a 2×8 array of individual, blister cavities. The pack has a lid foil layer connected to a base foil layer with two parallel and offset rows of individual blisters, wherein perforation lines on each side of the lid foil divide the blister rows, and perforation lines, perpendicular to the lid foil layer divide each offset row. At each intersection of parallel and perpendicular, perforation lines, there is a notch cavity. In removing a pill from a blister cavity, an individual blister is separated from the pack along the perforation lines, exposing the layers underneath the notch cavity. The layers peel away from the blister cavity to dislodge the pill.

There is a need for a more advanced blister package. A package that provides adequate sealing and child safety, yet is manageable for an adult to easily open, while also incorporating the features of a treatment card, i.e. providing dosage instructions, safety precautions, etc. For example, the pharmaceutical treatment blister card may have instructional information printed on the packaging itself, or it may contain all relevant information within the blister card to which consumers may refer. The pharmaceutical treatment blister card may also contain a compartment that enables the user to maintain a written log relating to the usage of the product contained therein with as little inconvenience as possible.

SUMMARY OF THE INVENTION

The present invention is directed to a pharmaceutical treatment blister card, suitable for dispensing a pharmaceutical composition, characterized as:

a) interior and exterior layers having outer edges, the surface of the interior layer comprises a hole therein, and the exterior layer comprises a perforated-portion having the shape of a hole, the interior layer overlays the exterior layer, wherein the hole of the interior layer opposes the perforated-portion of the exterior layer, a first portion of the interior and exterior outer edges are affixed together to form a blister card having a pocket there inside, an unaffixed, second portion of the interior and exterior edges form a pocket entrance into the card;

b) one or a plurality of blister cavities comprising a blister layer having outer edges and a lidding layer having outer edges, the edges of the blister and lidding layers are affixed together, a raised void compartment is formed inside the edges of the layers suitable for storage of a pharmaceutical composition, the blister cavity is located in the pocket of the blister card, the raised void compartment of the blister cavity protruding through the hole of the interior layer, and the lidding layer opposes the perforated-portion of the exterior layer;

c) a removable security strip, the strip being inserted through the pocket entrance into the pocket of the card between the lidding layer of the blister cavity and the exterior layer of the card, the security strip being within the edges of the pocket entrance; and d) a perforation strip sealing the interior and exterior edges and pocket entrance of the blister card, wherein the removable security strip is sealed inside the blister card to form the pharmaceutical treatment blister card, wherein tearing the perforation strip from the blister card, removing the security strip, and pushing against the blister layer at the interior layer forcing the lidding layer to rupture forcing the perforated-portion of the exterior layer away from the card and dislodging the pharmaceutical composition from the blister cavity.

DETAILED DESCRIPTION OF THE INVENTION

Figure 1:
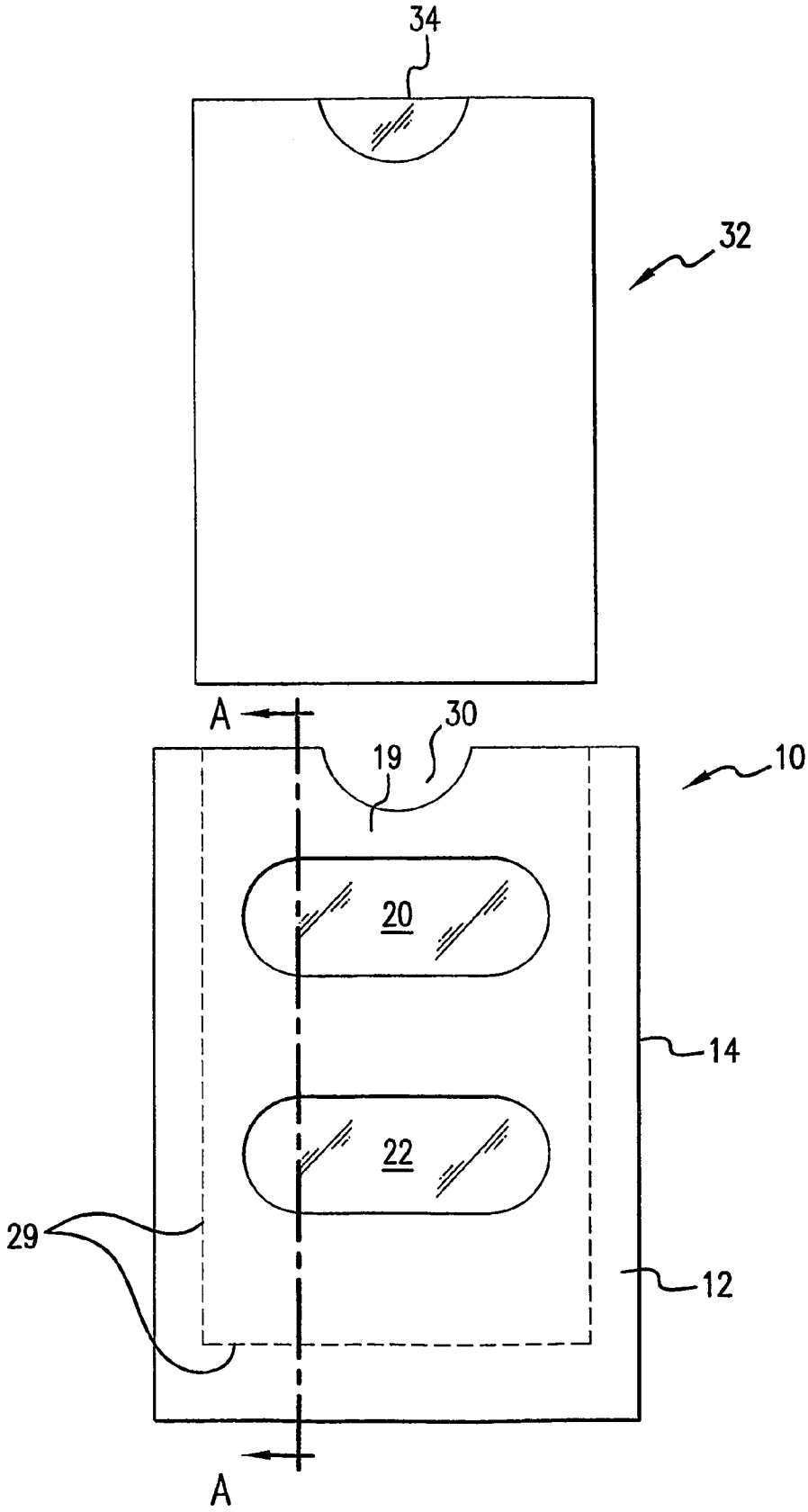
FIG. 1 is a front view in elevation of pharmaceutical treatment blister card section 10 having blister cavities 20 and 22, wherein security strip 32 is shown therein above.

As used herein the term "uniform edge" is defined as edges of individual layers that are attachable to one another to form a single structure, wherein the edges of exterior and interior layers of the multi-laminated assembly may be affixed together to form a single unit assembly.

The term "multi-laminate assembly" is defined as a structure having a plurality of separate layers, affixed or unaffixed, operating together to form a single layered unit.

As used herein the term "proportionally dimension sides" means the exterior and interior layers of a multi-laminated assembly may be identical in shape (e.g., rectangular, triangular, oval, elliptical, etc.) and size, or generally conform to similar shape but of different sizes so that all the layers define the same general shape.

The term "interior layer" is defined as the inside surface of a card section containing blister cavity void compartment therein and slits for storing literature sheets. The interior layer may contain indicia in the form of literature and instructional materials, as well as methods of assisting a user to schedule dosage administration intervals.

The term "exterior layer" is defined as the outside surface of a card section that incorporates the perforation-portion in the shape of a hole opposite and adjacent to the lidding layer of the blister cavity. The exterior layer may contain literature and instructional materials, as well as methods of assisting a user to schedule dosage administration intervals.

The terms "sealed" and "affixed" as used herein means attachment of the interior and exterior layers of the card section, and attachment of the blister and lidding layers of the blister cavity. The blister cavity compartment is defined as an air tight and moisture-proof compartment having normally 2-3 year shelf life once the lidding layer and blister layer are attached.

As used herein the term "hinge means" or "pivoting means" means creases, lines or other folding properties incorporated into a pharmaceutical card, wherein the card sections may be folded or pivoted against one another along bifurcated outer card section edges.

The term "removable security strip" as used herein refers to a planar strip that may be removably inserted into the pocket formed by affixing a portion of the outer edges of the interior and exterior cards. The security strip provides security and protection against child tampering (e.g. poking, biting, etc.,) by blocking removal of the composition from blister cavity when pressure or force is applied thereto.

The terms "proximal" and "adjacent" as used herein refers to layers of the multi-laminated assembly that are sufficiently close or abutting one another within the assembly.

The phrase "cut-out" as used herein refers to a removed-portion of the top, bottom or side edges of the interior and exterior layers that are in the form of a semi-circle or square approximating the size and shape of the human thumb. The cut-out section exposes a section of the removable security strip, i.e. pull-point, to aid in the removal of the security strip.

The term "pull-point " as used herein refers to an edge-portion of the security strip opposing the cut-out of the interior and exterior layers, wherein the security strip may be removed from the pocket of the card section.

The present invention is directed to a pharmaceutical treatment blister card suitable for dispensing a pre-measured dosage of a pharmaceutical composition. The blister card may be characterized as containing at least one whole medicament compartment, i.e. blister cavity, for storing at least one unit dosage of a medicament or pharmaceutical composition therein. The invention may be further characterized as a uniform edged, multiple layered, laminate assembly characterized by one or more blister cavities that are proportionally dimensioned and incorporated into a card. The multi-laminated assembly may be characterized as containing an interior layer, blister layer, lidding layer, security card layer, and exterior layer, wherein the layers are in close proximity to one another.

Figure 2:
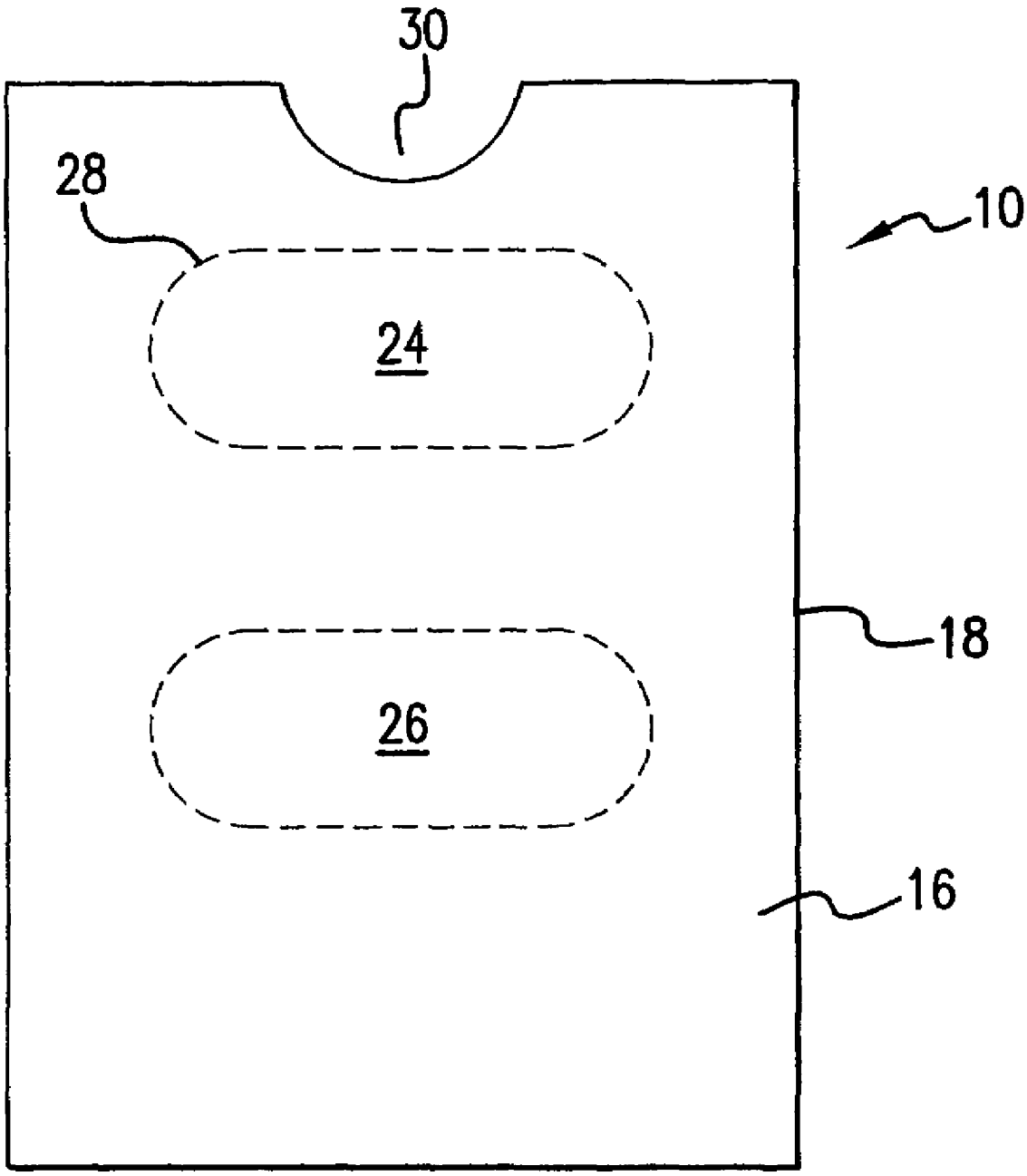
FIG. 2 is an back view elevation of pharmaceutical treatment blister card section 10 having perforated backing 18.

Referring to FIGS. 1 and 2, there is shown a front view of pharmaceutical treatment blister card 10 and security strip 32. The card may be characterized as a uniformly dimensioned, interior layer 12 having outer edges 14 along the peripheral boundary thereof. Within the surface of interior layer 14 are holes 20 and 22, and cut-out section 30. Referring to FIG. 2, there is shown a rear view of pharmaceutical treatment blister card 10 that may be characterized as a uniformly dimensioned, exterior layer 16 having outer edges 18 along the peripheral boundary thereof. Within the surface of exterior layer 16 are perforated-portions 24 and 26 characterized by perforations 28, and cut-out 30. Typically, interior layer 12 and exterior layer 16 are of similar dimensions so that the layer are mirror images of one another and outer edges 14 and 18 will oppose one another when overlaid. Upon overlaying the interior and exterior layers, and affixing the edges thereof, a card section is formed having pocket 19 formed between the 2-layers (pocket 19 is shown in FIG. 1 as hidden lines 29). Security strip 32, shown in FIG. 1, containing pull-point 34 may be inserted into pocket 19 (between interior layer 12 and exterior layer 16).

In one preferred embodiment of the invention, individual card sections having one or more blister cavities may be linked together by pivoting or hinge means to form multi-fold cards, e.g. bi-fold and tri-fold cards. The exterior and interior layers of the card section may be further characterized as containing top, bottom and side edges. The interior and exterior card layers may be attached together at their top, bottom or side edges, leaving one side open so that an inner pocket is formed within the 2-layer assembly, wherein the blister cavities containing the pharmaceutical composition, already sealed inside the cavities, may be inserted. Generally, several blister cavity compartments may be fabricated from a single blister layer and lidding by methods known in the art. The blister cavity void containing the pharmaceutical composition may be visible through a hole in the interior card layer, wherein a void in the cavity protrudes beyond the interior layer surface. The exterior layer, directly opposite the blister cavity, may contain a perforation-portion in the general shape of an ellipse, oval, circle, square, etc. to facilitate removal of the composition from the cavity. Inside the inner pocket formed by the interior and exterior card layers, one or more blister cavities containing pharmaceutical composition may be placed. Between the lidding layer of the cavities and the exterior card layer of the multi-laminate structure, a removable security card may be inserted into the pocket formed by sealing a portion of the outer edges of the card, wherein the security card fits within the pocket formed. Generally, the removable security card is placed between the lidding layer of the blister cavity and the exterior layer of the card section so that the pharmaceutical composition within the blister cavity cannot easily be dislodged from the cavity, through the lidding layer, without removal of the security strip and breaking the lidding layer. The strips are generally located between the lidding layer of the blister package and the exterior layer of the card. The width, length and shape of the security strip will generally extend beyond the width of blister cavities, but with in the width of the pocket and its opening. After the security card is inserted into the pocket, the unsealed portion of the outer edges that form the pocket of the interior and exterior layers may be sealed, preferably with a perforation strip.

Figure 3:
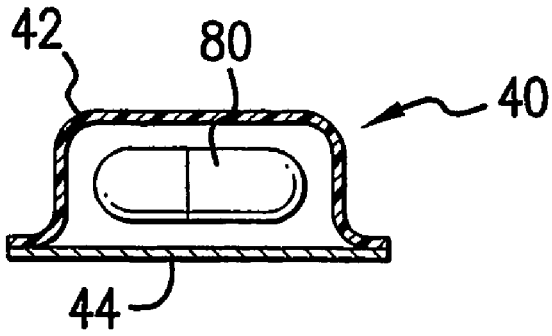
FIG. 3 is a side view in elevation of blister cavity 80.

Referring to FIG. 3, there is shown a side view of blister cavity 40 characterized blister layer 42 and lidding layer 44, wherein a cavity void is formed by sealing the outer edges of the 2-layers together, wherein pharmaceutical composition 80 is contained there between. The blister cavity may be affixed between the interior and exterior layers, inside the pocket formed by the multi-laminate assembly. The blister cavity may be characterized as a 2-piece structure containing a front side and back sides, sealed edges and one or more raised, blister cavity compartments that extend through one or more holes in the surface of the interior card layer. The blister layer of the blister card may be a transparent and flexible polymeric material having a plurality of individual blister cavity compartments formed therein. Typically, the blister cavity compartment is of sufficient volume or size to contain a single, pre-measured dosage of a pharmaceutical composition therein, wherein the composition is typically a pill, tablet, capsule, powder or the like. The blister cavity provides a void space between the blister and the lidding layers. The blister and lidding layers may be constructed of a polymeric material such as polyvinylchloride (PVC), polyvinyldenechloride (PVDC), polyolefins, polypropylene, aluminum foil laminate, polyacetal, polyolefins, polystyrene, and blends thereof. Alternatively, they may be made up of a non-transparent, not easily rupturable, flexible material such as, a metal foil laminate (e.g., PVC/aluminum/Nylon) with a thickness of foil from 15 microns to about 30 microns thickness. Suitable thickness of the blister and lidding suitable to prevent easy rupture. The blister cavities may be opened according to a method of tearing the perforation strip, removing the security strip from the card section, and pushing the blister cavity from the interior layer side through the perforation-portion of the exterior layer.

Figure 4:
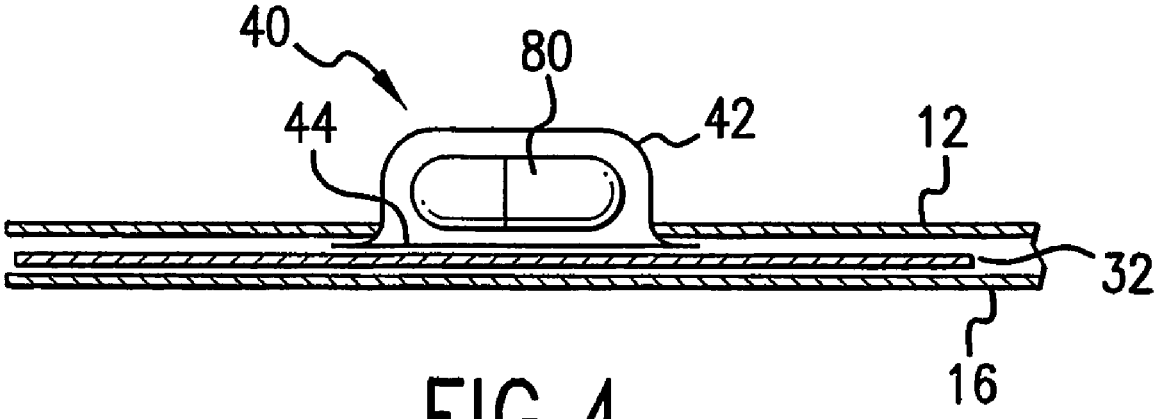
FIG. 4 is a side view in elevation along section A-A of pharmaceutical treatment blister card 10 of FIG. 1.

Referring to FIG. 4, there is shown a side view of FIG. 1 taken along section A-A. The pharmaceutical treatment blister card of the invention may be characterized as a multi-laminated structure comprising interior layer 12 and exterior layer 16 having removable security strip 32 inserted there between. Through hole 20 in interior layer 12-blister cavity 40 containing pharmaceutical composition 80 may be placed. Opposing blister cavity 40 in the multi-laminated structure is perforated-portion 24 in exterior layer 16 that opposite hole 20 of interior layer 12.

Perforation strip 50 that span the length of a pocket entrance of the pharmaceutical treatment blister card may be attached to unaffixed-portion of the exterior and interior layers that formed the pocket entrance of the card section to seal the removable security strips within the card section, thus preventing opening of the blister cavity therefrom. The security strip is removed by placing one or more fingers on the top area that is exposed by the cut-out sections of the interior and exterior layers (referred to as pull-point) and pulling or lifting it out of the pocket. The pull-point may be marked in such a way to indicate its location versus any other area on the outer edge of the pharmaceutical treatment blister card. Thereafter a force may be applied to the blister cavity at the interior layer of the card section, forcing the pharmaceutical composition against the lidding layer, which forces the perforation-portion of the exterior layer to separate therefrom, and liberating the composition from the blister cavity. The security strip may be generally constructed of a paper or polymeric material suitable for incorporating indicia in the form of printed media thereon. Typically, it may be fabricated from a paperboard or polymeric stock materials. The paperboard material may be selected from the group consisting of cardboard, bristle board and corrugated paper. The polymeric stock material may be suitably selected from polyacetal, polyolefins, polystyrene, polyvinylchloride and blends thereof; a particularly preferred material in a paperboard.

Figure 5:
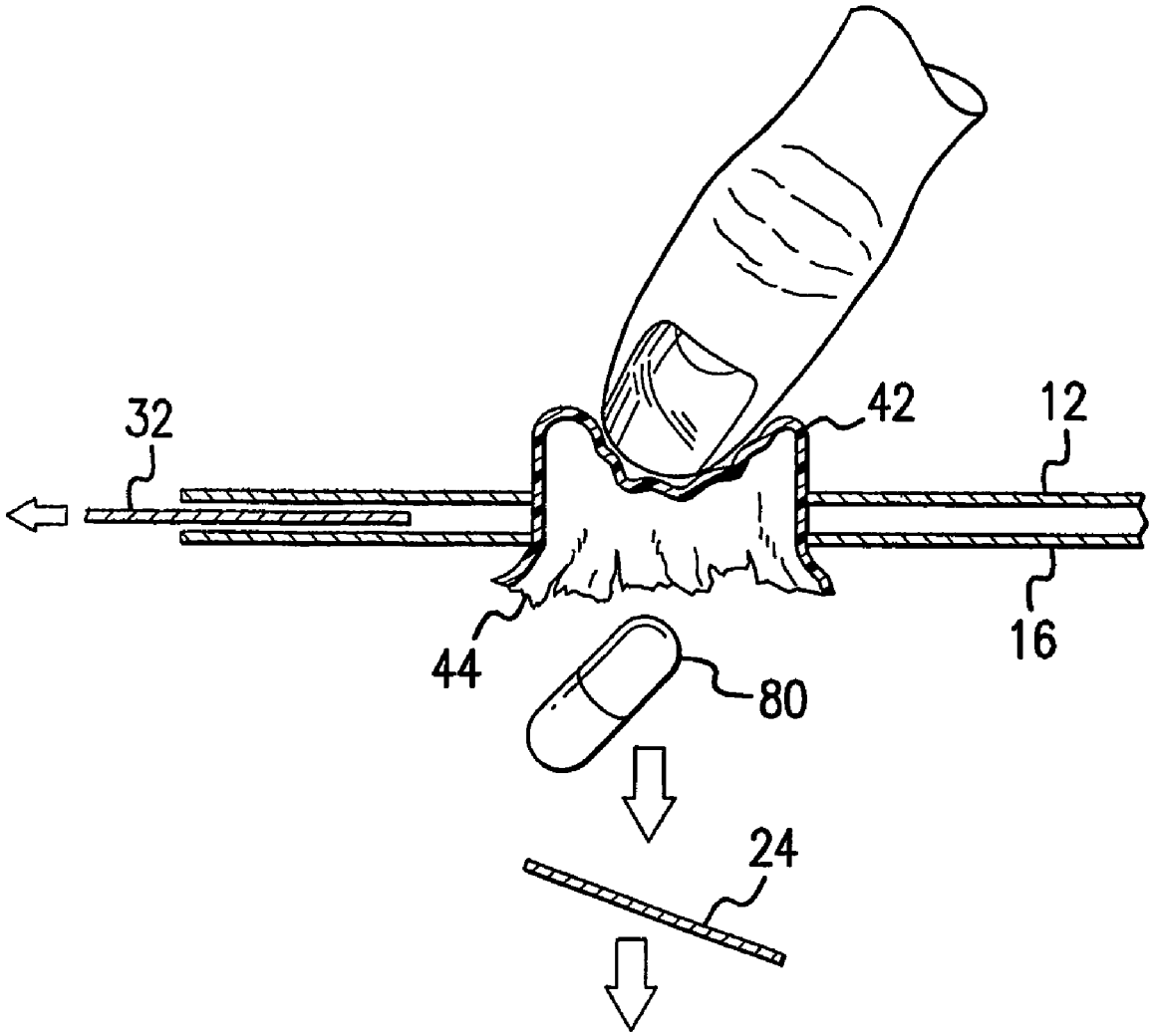
FIG. 5 is a side view in elevation along section A-A of pharmaceutical treatment blister card 10, wherein blister cavity 40 has been broken and pharmaceutical composition 80 dislodged therefrom.

Referring to FIG. 5, there is shown a side view of FIG. 1 taken along section A-A, wherein security strip 32 has been removed from the multi-laminated assembly, blister layer 42 has been forced into pharmaceutical composition 80, wherein the force causes the lidding layer 44 of blister cavity 40 to rupture, the pharmaceutical composition has been dislodged from the treatment card, and perforation-portion 24 has been dislodged from exterior layer 16. Prior to dislodging the pharmaceutical composition from the treatment card, the security strip must be removed from pocket 19 of the card section formed by the interior and exterior layers.

Figure 6:
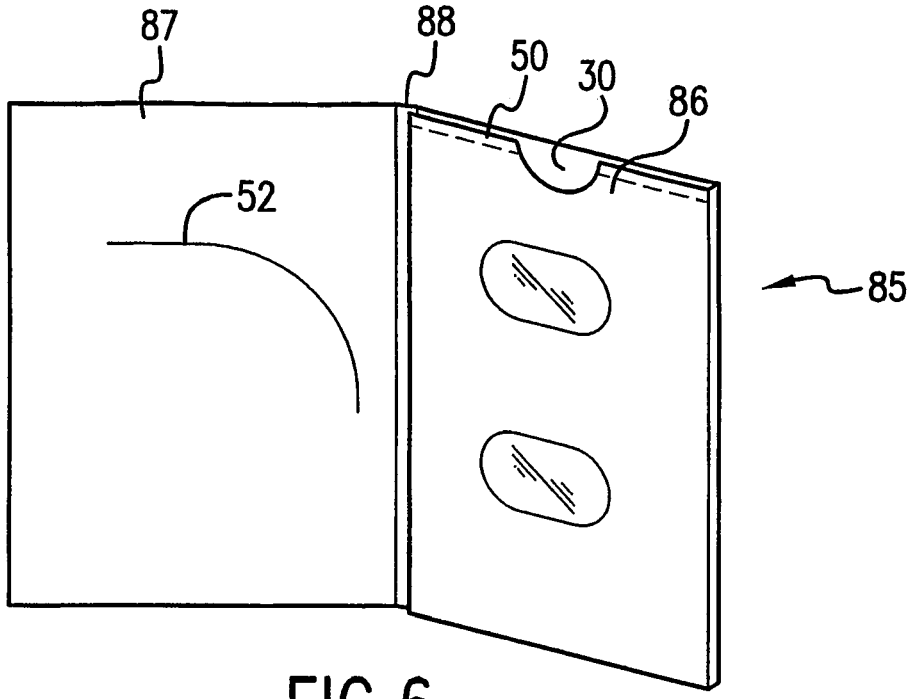
FIG. 6 is a perspective view in elevation of bi-fold card 80 of the present invention.

Referring to FIG. 6, there is shown a typical embodiment of the invention, wherein the interior of bi-fold card 85 may be characterized as card sections 86 and 87 attached by hinge means 88. On the interior layer of card section 87 is located slit 52 which forms a pocket between the interior and exterior layers of the card section. The card section pocket is suitable for placement of literature sheets relating to dosing schedule or safety of the pharmaceutical composition. On the interior side of card section 86 are incorporated blister cavities 20 and 22. The top edge of card section 85, covered by perforation strip 50, is the security strip. To remove the pharmaceutical composition from the card section, perforation strip 50 must be torn from the top of the card section to expose the security strip. Thereafter, by grasping cut-out 30, the security strip may be withdrawn from the pocket, and applying a pressure force to the blister cavity at the interior layer of the card section, the pharmaceutical composition may be forced against the lidding layer of the cavity which forces the perforation-portion of the exterior layer therefrom to dislodge the composition from the treatment card. Without removal of the perforation strip from the card section, followed by removal of the security strip, and applying a force to the blister cavity at the interior layer of the card section, the composition is not removable from the pharmaceutical treatment blister card.

The bi-fold card of the present invention may be characterized as containing at least two card sections, one or more card sections, characterized as:

a) interior and exterior layers having uniform outer edges, wherein the surface of the interior layer comprises a hole therein, and the exterior layer comprises a perforated-portion having the shape of a hole, wherein the interior layer overlays the exterior layer, wherein the hole of the interior layer opposes the perforated-portion of the exterior layer, wherein a first portion of the interior and exterior uniform outer edges are affixed together to form a blister card section having a pocket there inside, wherein an unaffixed, second portion of the card edges form a pocket entrance into the card, wherein a cut-out is formed about the outer edges of the pocket entrance of the card;

b) one or a plurality of blister cavities, each cavity comprising a blister layer having outer edges and a lidding layer having outer edges, wherein the edges of the blister and lidding layers are affixed together, wherein a raised, void compartment is formed inside the edges of the layers suitable for storage of a pharmaceutical composition, wherein the blister cavity is located in the pocket of the blister card, the raised void compartment of the blister cavity protruding through the hole of the interior layer, and wherein the lidding layer opposes the perforated-portion of the exterior layer;

c) a removable security strip having first and second ends, wherein the pull point is located at the second end of the strip, wherein the first end of the strip is inserted through the pocket entrance into the card between the lidding layer of the blister cavity and the exterior layer of the card, the security strip being within the edges of the pocket entrance, the pull point fitting within the outer edges of the pocket entrance and being visibly exposed through the cut-out of the card;

d) a perforation strip suitable for sealing the outer edges of the card at the pocket entrance thereof, wherein the removable security strip is sealed inside the outer edges of the blister card to form a card section, and wherein the pull point is covered by the perforation strip;

e) optionally, a card section having interior and exterior layers, the layers having affixed outer edges to form a pocket there between, wherein a slit in the interior layer provides a pocket for storing literature sheets; and f) hinge means attaching the outer edges of the at least two card sections together to form a bi-fold pharmaceutical treatment blister card, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

Figure 7A:
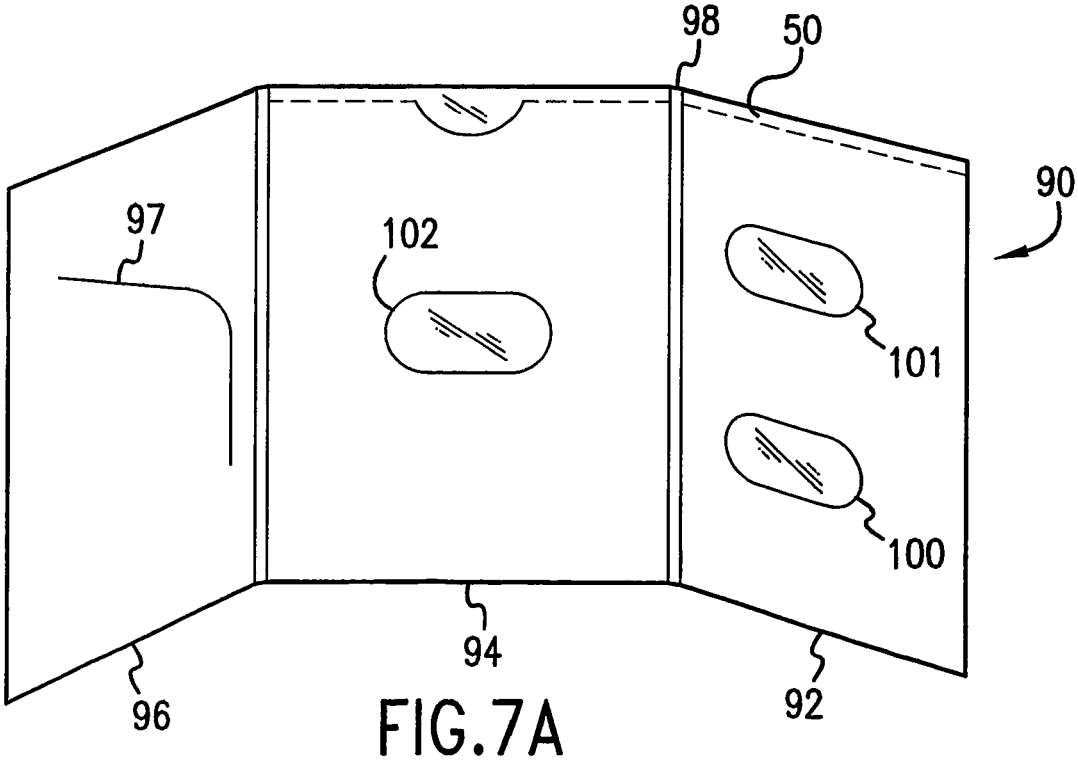
FIG. 7A is a perspective view in elevation of tri-fold card 90 of the present invention.

Referring to FIG. 7A, there is shown a perspective view of another embodiment of the present invention, tri-fold card 90 characterized by card sections 92, 94 and 96. Card sections 92 and 94 incorporate blister cavities 100, 101, and 102, wherein the top edge of the card sections are sealed by a perforation strip 50 similar to card section 86 herein before. The card sections are attached together by way of hinge means 98, and card section 96, contains slit 97 suitable for storage of literature. In accordance with FIG. 7B, there is shown a top view of tri-fold card 90 in the folded position, wherein card sections 92, 94 and 96 are atop one another. In the folded position, the blister cavities of the card are vertically aligned and cavity 102 is positioned between cavities 100 and 101.

In another embodiment of the invention, there is described a tri-fold, pharmaceutical treatment blister card characterized as containing at least three card sections suitable for folding upon one another, one or more card sections, comprising:

a) interior and exterior layers having uniform outer edges, wherein the surface of the interior layer comprises one or more holes therein, and the exterior layer comprises one or more perforated-portions having the shape of one or more holes, wherein the interior layer overlays the exterior layer, wherein the holes of the interior layer opposes the perforated-portions of the exterior layer, wherein a first portion of the interior and exterior uniform outer edges are affixed together to form a blister card section having a pocket there inside, wherein an unaffixed, second portion of the card edges form a pocket entrance into the card, wherein a cut-out is formed about the edges of the pocket entrance of the card;

b) a plurality of blister cavities on the at least two card sections, each cavity comprising a blister layer having outer edges and a lidding layer having outer edges, wherein the edges of the blister and lidding layers are affixed together, wherein raised void compartments are formed inside the edges of the layers suitable for storage of a pharmaceutical composition, wherein the blister cavities are located in the pocket of the blister card, the raised void compartments of the blister cavities protruding through the holes of the interior layer and the lidding layer opposing the perforated-portions of the exterior layer;

c) a removable security strip having first and second ends a pull point, wherein the pull point is located at the second end of the strip, wherein the first end of the strip is inserted through the pocket entrance into the pocket of the card between the lidding layer of the blister cavity and the exterior layer of the card, the security strip being within the edges of the pocket entrance, the pull point fitting within the outer edges of the pocket entrance and being visibly exposed through the cut-out of the card;

d) a perforation strip sealing the pocket entrance of the blister card, wherein the removable security strip is located inside the pocket to form the pharmaceutical treatment blister card, and wherein the pull point is covered by the perforation strip;

e) optionally, a card section having interior and exterior layers, the layers having outer edges, wherein the outer edges of the layers are affixed together, wherein a slit in interior layer provides a pocket for storing literature sheets; and f) hinge means attaching the outer edges of the at least three card sections together to form a tri-fold pharmaceutical treatment blister card, wherein the hinge means is suitable for folding sections of the card upon one another, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

Figure 7B:
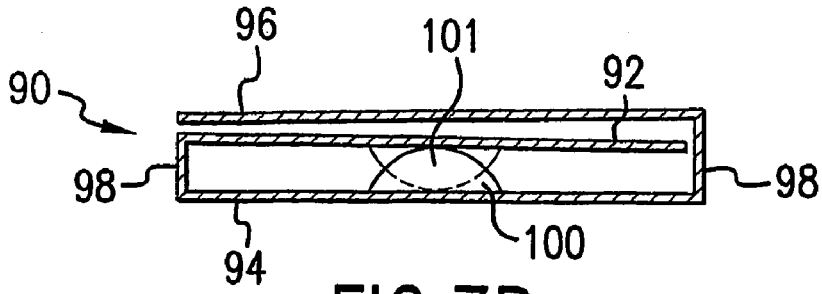
FIG. 7B is a top view in elevation of tri-fold card 90 of the present invention, wherein blister cavities of 2 card sections are vertically aligned and staggered when the card is in the folded position.

In this as well as earlier described embodiment, preferably, the edges of the interior and exterior layers of the cards are uniformly dimensioned, and a plurality of blisters may be located on the card sections. Also, the card sections may be attached by hinge means, and literature may be written on the interior and exterior layers of the cards. A section of the tri-fold pharmaceutical treatment blister card may contain at least one card section that has a slit in the interior layer thereof suitable for storage of literature relating to the pharmaceutical composition. The card may also contain a plurality of blister cavities that are located in the interior layer of at least one card section, and a plurality of blisters is located on two card sections of a bi-fold or tri-fold card. In a more preferred embodiment of the invention, 2 card sections, attached at their edges by hinge means, containing a plurality of blister cavities may be further characterized by the blister cavities on at least 2 card sections are aligned in a staggered formation when the card sections are folded against one another, as shown in FIG. 7B. Of course, the blister cavities will store a measured dosage of a pharmaceutical composition in the form of capsules, tablets, powders, granules, etc. and combinations thereof e.g. generally in a solid form. The blister cavity may contain a plurality of individually sealed, child resistant blister cavity compartments arranged in an aligned and staggered manner, wherein when one card sections are folded upon another, the cavities are aligned and altered from card to card.

Generally, the card sections of the treatment card, that is the interior and exterior layers, security strip, and perforation strip may be fabricated from a material selected from paperboard, card board, bristle board, corrugated paper, polymeric materials, metals, and combinations thereof. These as well as other materials of construction will become apparent to those skilled in the art. The blister and lidding layers of the blister cavity may be fabricated from polymeric materials, metal foils, and combinations thereof. Such polymeric materials include, but are not limited to low density polyethylene, an olefinic copolymer, polyvinylchloride, polyvinyldenechloride, polyolefins, polypropylene, polyesters, polylactic acid, polyacetals, polystyrene, and combinations thereof; a particularly preferred material in a paperboard.

In one embodiment, a portion of the top edges and the bottom and side edges of the interior and exterior layers of the card as well as the back of the blister layer and lidding layer of the blister package are formed into a unitary laminate. A heat seal coating is used to bond the edges of interior and exterior layers and the blister layers where appropriate. The blister layer and lidding layer may be bonded together with an adhesives that are generally constructed from a thermoplastic, binding material that is heat sealable to ensure that the layers are permanently attached to one another. Other adhesives known in the art that may be suitable for the present invention will become readily apparent to those skilled in the art.

In another preferred embodiment of a tri-fold pharmaceutical treatment blister card suitable dispensing a pharmaceutical composition, the card may be characterized as containing three card sections suitable for folding upon one another, characterized as:

i) two card sections, further characterized as:

a) interior and exterior layers having uniform outer edges, wherein the surface of the interior layer comprises a plurality of holes therein, and the exterior layer comprises a plurality of perforated-portions having the shape of the plurality of holes, wherein the interior layer overlays the exterior layer, wherein the plurality of holes of the interior layer opposes the plurality of perforated-portions of the exterior layer, wherein a first portion of the interior and exterior uniform outer edges are affixed together to form a blister card section having a pocket there inside, wherein an unaffixed, second portion of the card edges form a pocket entrance-into the card, wherein a cut-out is formed about the edges of the pocket entrance of the card;

b) a plurality of blister cavities on the at least two card sections, each cavity comprising a blister layer having outer edges and a lidding layer having outer edges, wherein the edges of the blister and lidding layers are affixed together, wherein raised void compartments are formed inside the edges of the layers suitable for storage of a pharmaceutical composition, wherein the blister cavities are located in the pocket of the blister card, the raised void compartments of the blister cavities protruding through the holes of the interior layer and the lidding layer opposing the perforated-portions of the exterior layer, and wherein the plurality of blister cavities on the two sections of the card are aligned in a staggered formation when the two card sections comprising blister cavities are folded against one another;

c) a removable security strip having first and second ends a pull point, wherein the pull point is located at the second end of the strip, wherein the first end of the strip is inserted through the pocket entrance into the pocket of the card between the lidding layer of the blister cavity and the exterior layer of the card, the security strip being within the edges of the pocket entrance, the pull point fitting within the outer edges of the pocket entrance and being visibly exposed through the cut-out of the card; and d) a perforation strip sealing the pocket entrance of the blister card, wherein the removable security strip is located inside the pocket to form the pharmaceutical treatment blister card, and wherein the pull point is covered by the perforation strip; and ii) one card section, comprising interior and exterior layers, the layers having outer edges, wherein the outer edges of the layers are affixed together, wherein a slit in interior layer provides a pocket for storing literature sheets; and iii) hinge means attaching the outer edges of the three card sections together to form a tri-fold pharmaceutical treatment blister card, wherein the hinge means is suitable for folding the sections of the card upon one another, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

Figure 8:
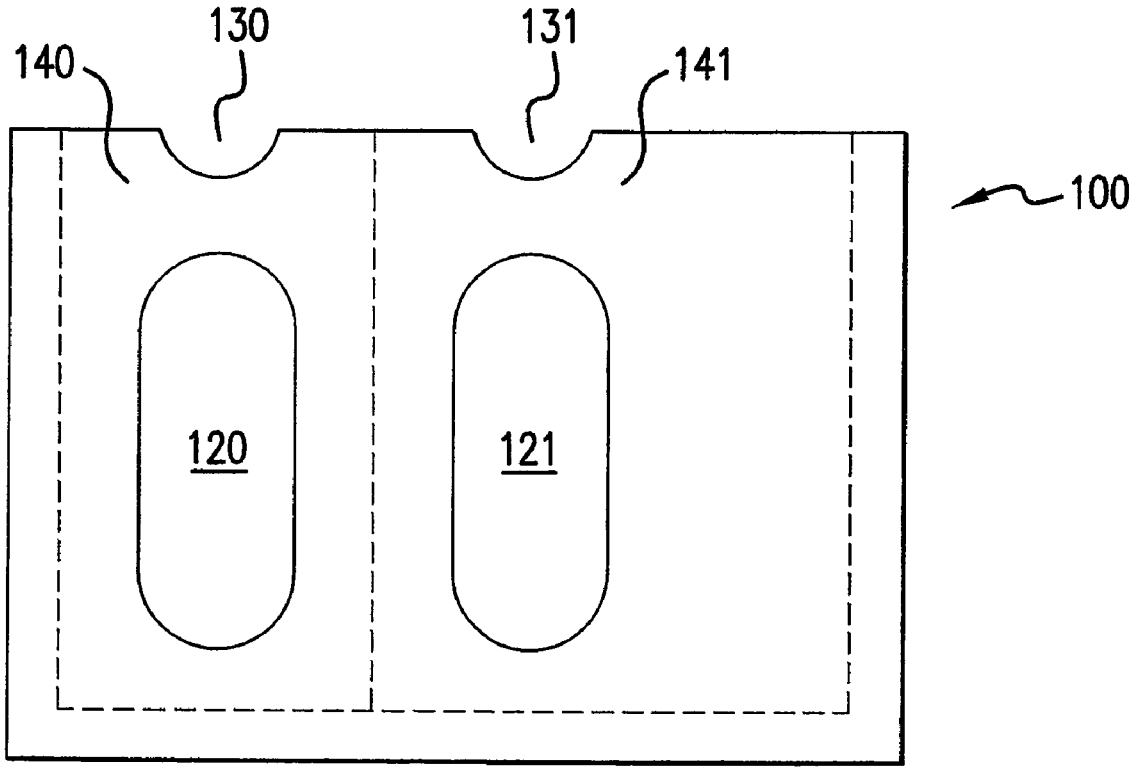
FIG. 8 is a front view in elevation of pharmaceutical treatment blister card section 100, wherein individual blister cavities 120 and 121 are shown.

Alternatively, the blister package may be characterized as containing a plurality of child resistant blister cavity compartments that are sealed as a group, i.e. on security strip versus several strips per card section. In FIG. 8, there is provided a front view in relief of yet another embodiment of the present invention, wherein card section 100 may be characterized as having 2 separate blister cavities 120 and 121, 2 separate cut-outs 130 and 131, and 2 separate pockets 140 and 141 (out lined by the dashed lines) for containing 2 separate security strips (not shown). Using this configuration, separate dosages of a pharmaceutical composition may be removed from the card without reducing the security of the remaining composition on the card section. Individual perforation strip as described herein earlier, suitable for enclosing the individual security strips is contemplated. The pharmaceutical treatment blister card will generally contain instructions and aides to assist a patient in administering an individual dosage of the pharmaceutical composition in a timely manner. These instructions and aides may be printed on the card itself. Alternatively, the blister card may contain an additional card section containing a slit therein to create a pocket for the storage of additional literature in the form of advertisement, instructions, calendars reminders, aides, etc. This additional chamber may contain one or more blister cavities and the slit.

The pharmaceutical treatment card has the advantages of containing, in addition to individual pre-measured dosages of a pharmaceutical composition, indicia thereon to assist a patient in timely administer the composition as scheduled. Generally, these cards may contain one cycle or weekly prescription (a single dosage per day) or one monthly prescription (single or multiple dosages per week); preferably 1 or 2 unit dosages per card section.

What is claimed:

1. A pharmaceutical treatment blister card, suitable for dispensing a pharmaceutical composition, comprising:

a) interior and exterior layers having outer edges, the interior layer comprises a hole therein, and the exterior layer comprises a perforated-portion having the shape of a hole, the interior layer overlays the exterior layer, the hole of the interior layer opposes the perforated-portion of the exterior layer, a first portion of the interior and exterior outer edges are affixed together to form a blister card having a pocket there inside, an unaffixed, second portion of the interior and exterior edges form a pocket entrance into the card;

b) one or a plurality of blister cavities comprising a blister layer having outer edges and a lidding layer having outer edges, the edges of the blister and lidding layers are affixed together, a raised void compartment is formed inside the edges of the layers suitable for storage of a pharmaceutical composition, the blister cavity is located in the pocket of the blister card, the raised void compartment of the blister cavity protruding through the hole of the interior layer, and the lidding layer opposes the perforated-portion of the exterior layer;

c) a removable security strip, the strip being inserted through the pocket entrance into the pocket of the card between the lidding layer of the blister cavity and the exterior layer of the card, the security strip being within the edges of the pocket entrance; and d) a perforation strip sealing the interior and exterior edges and pocket entrance of the blister card, wherein the removable security strip is sealed inside the blister card to form the pharmaceutical treatment blister card, wherein tearing the perforation strip from the blister card, removing the security strip, and pushing against the blister layer at the interior layer forcing the lidding layer to rupture forcing the perforated-portion of the exterior layer away from the card and dislodging the pharmaceutical composition from the blister cavity.

2. The blister card according to claim 1, wherein a slit in interior layer of the card suitable for storing literature sheets.

3. The blister card according to claim 2, wherein the outer edges of the interior and exterior layers are uniformly dimensioned.

4. The blister card according to claim 3, wherein a plurality of blisters are located on the card.

5. The blister card according to claim 4, wherein a plurality of cards are attached by hinge means.

6. The blister card according to claim 5, wherein literature is written on the interior and exterior layers of the cards.

7. The blister card according to claim 6, having a slit in the interior layer of the card suitable for storage of literature in the pocket.

8. The blister card according to claim 7, wherein the interior and exterior layers, security strip, and perforated strip are fabricated from a material selected from paperboard, card board, bristle board, corrugated paper, polymeric materials, and metals.

9. The blister card according to claim 8, wherein the blister and lidding layers are fabricated from a material selected from polymeric materials, metal foils, and combinations thereof.

10. The blister card according to claim 9, wherein the polymeric material is selected from low density polyethylene, an olefinic copolymer, polyvinylchloride, polyvinyldenechloride, polyolefins, polypropylene, polyesters, polylactic acid, polyacetals, polystyrene, and combinations thereof.

11. The blister card according to claim 10, wherein a plurality of cards are attached at the sealed edges by hinge means to one another to form a multifold card suitable for formation of a pharmaceutical treatment kit.

12. A bi-fold pharmaceutical treatment blister card suitable for dispensing a pharmaceutical composition, characterized as containing at least two card sections, one or more card sections, comprising:

a) interior and exterior layers having uniform outer edges, wherein the interior layer comprises a hole therein, and the exterior layer comprises a perforated-portion having the shape of a hole, wherein the interior layer overlays the exterior layer, wherein the hole of the interior layer opposes the perforated-portion of the exterior layer, wherein a first portion of the interior and exterioruniform outer edges are affixed together to form a blister card section having a pocket there inside, wherein an unaffixed, second portion of the card edges form a pocket entrance into the card, wherein a cut-out is formed about the outer edges of the pocket entrance of the card;

b) one or a plurality of blister cavities, each cavity comprising a blister layer having outer edges and a lidding layer having outer edges, wherein the edges of the blister and lidding layers are affixed together, wherein a raised, void compartment is formed inside the edges of the layers suitable for storage of a pharmaceutical composition, wherein the blister cavity is located in the pocket of the blister card, the raised void compartment of the blister cavity protruding through the hole of the interior layer, and wherein the lidding layer opposes the perforated-portion of the exterior layer;

c) a removable security strip having first and second ends, wherein the pull point is located at the second end of the strip, wherein the first end of the strip is inserted through the pocket entrance into the card between the lidding layer of the blister cavity and the exterior layer of the card, the security strip being within the edges of the pocket entrance, the pull point fitting within the outer edges of the pocket entrance and being visibly exposed through the cut-out of the card;

d) a perforation strip suitable for sealing the outer edges of the card at the pocket entrance thereof, wherein the removable security strip is sealed inside the outer edges of the blister card to form a card section, and wherein the pull point is covered by the perforation strip;

e) optionally, a card section of the at least two card sections having interior and exterior layers, the layers having affixed outer edges to form a pocket there between, wherein a slit in the interior layer provides a pocket for storing literature sheets; and f) hinge means attaching the outer edges of the at least two card sections together to form a bi-fold pharmaceutical treatment blister card, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

13. The bi-fold pharmaceutical treatment blister card according to claim 12, wherein the edges of the interior and exterior layers are uniformly dimensioned.

14. The bi-fold pharmaceutical treatment blister card according to claim 13, wherein a plurality of blister cavities are located on the card.

15. The bi-fold pharmaceutical treatment blister card according to claim 14, wherein the plurality of blister cavities on the at least two card sections are aligned so that when the card is folded, the cavities on the cards are alternatively arranged.

16. The bi-fold pharmaceutical treatment blister card according to claim 15, wherein the card sections are attached by hinge means.

17. The bi-fold pharmaceutical treatment blister card according to claim 16, wherein literature is written on the interior and exterior layers of the cards.

18. The bi-fold pharmaceutical treatment blister card according to claim 17, wherein a plurality of blister cavities are located in at least one card section.

19. The bi-fold pharmaceutical treatment blister card according to claim 18, wherein the plurality of blisters is located on two card sections thereof.

20. The bi-fold pharmaceutical treatment blister card according to claim 19, wherein the plurality of blisters on two sections of the card are aligned in a staggered formation.

21. The bi-fold pharmaceutical treatment blister card according to claim 20, wherein the blister cavities contain the pharmaceutical composition.

22. The bi-fold pharmaceutical treatment blister card according to claim 21, wherein the pharmaceutical composition is in a form selected from pills, capsules, tablets, and combinations thereof.

23. The bi-fold pharmaceutical treatment blister card according to claim 22, wherein the interior and exterior layers, security strip, and perforated strip are fabricated from a material selected from paperboard, card board, bristle board, corrugated paper, polymeric materials, metals and combinations thereof.

24. The bi-fold pharmaceutical treatment blister card according to claim 23, wherein the blister and lidding layers are fabricated from a material selected from polymeric materials, metal foils, and combinations thereof.

25. The bi-fold pharmaceutical treatment blister card according to claim 23, wherein the polymeric material is selected from low density polyethylene, an olefinic copolymer, polyvinylchloride, polyvinyldenechloride, polyolefins, polypropylene, polyesters, polylactic acid, polyacetals, polystyrene, and combinations thereof.

26. The bi-fold pharmaceutical treatment blister card according to claim 24, wherein the polymeric material is selected from low density polyethylene, an olefinic copolymer, polyvinylchloride, polyvinyldenechloride, polyolefins, polypropylene, polyesters, polylactic acid, polyacetals, polystyrene, and combinations thereof.

27. A tri -fold pharmaceutical treatment blister card suitable dispensing a pharmaceutical composition, characterized as containing at least three card sections suitable for folding upon one another, one or more card sections, comprising:

a) interior and exterior layers having uniform outer edges, wherein the interior layer comprises one or more holes therein, and the exterior layer comprises one or more perforated-portions having the shape of one or more holes, wherein the interior layer overlays the exterior layer, wherein the holes of the interior layer opposes the perforated-portions of the exterior layer, wherein a first portion of the interior and exterior uniform outer edges are affixed together to form a blister card section having a pocket there inside, wherein an unaffixed, second portion of the card edges form a pocket entrance into the card, wherein a cut-out is formed about the edges of the pocket entrance of the card;

b) a plurality of blister cavities on the at least two card sections, each cavity comprising a blister layer having outer edges and a lidding layer having outer edges, wherein the edges of the blister and lidding layers are affixed together, wherein raised void compartments are formed inside the edges of the layers suitable for storage of a pharmaceutical composition, wherein the blister .cavities are located in the pocket of the blister card, the raised void compartments of the blister cavities protruding through the holes of the interior layer and the lidding layer opposing the perforated-portions of the exterior layer;

c) a removable security strip having first and second ends a pull point, wherein the pull point is located at the second end of the strip, wherein the first end of the strip is inserted through the pocket entrance into the pocket of the card between the lidding layer of the blister cavity and the exterior layer of the card, the security strip being within the edges of the pocket entrance, the pull point fitting within the outer edges of the pocket entrance and being visibly exposed through the cut-out of the card;

d) a perforation strip sealing the pocket entrance of the blister card, wherein the removable security strip is located inside the pocket to form the pharmaceutical treatment blister card, and wherein the pull point is covered by the perforation strip;

e) optionally, a card section of the least two card sections having interior and exterior layers, the layers having outer edges, wherein the outer edges of the layers are affixed together, wherein a slit in interior layer provides a pocket for storing literature sheets; and f) hinge means attaching the outer edges of the at least three card sections together to form a tri-fold pharmaceutical treatment blister card, wherein the hinge means is suitable for folding sections of the card upon one another, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

28. The tri-fold pharmaceutical treatment blister card according to claim 27, wherein the edges of the interior and exterior layers are uniformly dimensioned.

29. The tri-fold pharmaceutical treatment blister card according to claim 28, wherein a plurality of blisters are located on the card section.

30. The tri-fold pharmaceutical treatment blister card according to claim 29, wherein the card sections are attached by hinge means.

31. The tri-fold pharmaceutical treatment blister card according to claim 30, wherein literature is written on the interior and exterior layers of the cards.

32. The tri-fold pharmaceutical treatment blister card according to claim 31, wherein a plurality of blister cavities are located in said at least one card section.

33. The tri-fold pharmaceutical treatment blister card according to claim 32, wherein the plurality of blisters is located on two card sections thereof.

34. The tri-fold pharmaceutical treatment blister card according to claim 33, wherein the plurality of blister cavities on at least two sections of the card are aligned in a staggered formation when at least of the card sections comprising blister cavities are folded against one another.

35. The tri-fold pharmaceutical treatment blister card according to claim 34, wherein the blister cavities contain the pharmaceutical composition.

36. The tri-fold pharmaceutical treatment blister card according to claim 35, wherein the pharmaceutical composition is in the form of pills, capsules, tablets, and combinations thereof.

37. The tri-fold pharmaceutical treatment blister card according to claim 36, wherein the interior and exterior layers, security strip, and perforated strip are fabricated from a material selected from paperboard, card board, bristle board, corrugated paper, polymeric materials, and metals.

38. The tri-fold pharmaceutical treatment blister card according to claim 37, wherein the blister and lidding layers are fabricated from polymeric materials, metal foils, and combinations thereof.

39. The tri-fold pharmaceutical treatment blister card according to claim 37, wherein the polymeric material is selected from low density polyethylene, an olefinic copolymer, polyvinylchloride, polyvinyldenechloride, polyolefins, polypropylene, polyesters, polylactic acid, polyacetals, polystyrene, and combinations thereof.

40. The tri-fold pharmaceutical treatment blister card according to claim 38, wherein the polymeric material is selected from low density polyethylene, an olefinic copolymer, polyvinylchloride, polyvinyldenechioride, polyolefins, polypropylene, polyesters, polylactic acid, polyacetals, polystyrene, and combinations thereof.

41. A tri-fold pharmaceutical treatment blister card suitable dispensing a pharmaceutical composition, characterized as containing three card sections suitable for folding upon one another, comprising:

i) two card sections, comprising:

a) interior and exterior layers having proportionally dimension edges and uniform outer edges, wherein the interior layer comprises a plurality of holes therein, and the exterior layer comprises a plurality of perforated-portions having the shape of the plurality of holes, wherein the interior layer overlays the exterior layer, wherein the plurality of holes of the interior layer opposes the plurality of perforated-portions of the exterior layer, wherein a first portion of the interior and exterior uniform outer edges are affixed together to form a blister card section having a pocket there inside, wherein an unaffixed, second portion of the card edges form a pocket entrance into the card, wherein a cut-out is formed about the edges of the pocket entrance of the card;

b) a plurality of blister cavities on the at least two card sections, each cavity comprising a blister layer having outer edges and a lidding layer having outer edges, wherein the edges of the blister and lidding layers are affixed together, wherein raised void compartments are formed inside the edges of the layers suitable for storage of a pharmaceutical composition, wherein the blister cavities are located in the pocket of the blister card, the raised void compartments of the blister cavities protruding through the holes of the interior layer and the lidding layer opposing the perforated-portions of the exterior layer, and wherein the plurality of blister cavities on the two sections of the card are aligned in a staggered formation when the two card sections comprising blister cavities are folded against one another;

c) a removable, proportionally dimension security strip having first and second ends a pull point, wherein the pull point is located, at the second end of the strip, wherein the first end of the strip is inserted through the pocket entrance into the pocket of the card between the lidding layer of the blister cavity and the exterior layer of the card, the security strip being within the edges of the pocket entrance, the pull point fitting within the outer edges of the pocket entrance and being visibly exposed through the cut-out of the card; and d) a perforation strip sealing the pocket entrance of the blister card, wherein the removable security strip is located inside the pocket to form the pharmaceutical treatment blister card, and wherein the pull point is covered by the perforation strip; and ii) one card section, comprising interior and exterior layers, the layers having outer edges, wherein the outer edges of the layers are affixed together, wherein a slit in interior layer provides a pocket for storing literature sheets; and iii) hinge means attaching the outer edges of the three card sections together to form a tri-fold pharmaceutical treatment blister card, wherein the hinge means is suitable for folding the sections of the card upon one another, wherein tearing of the perforation strip from the blister card exposes the pull point of the security strip, pulling the pull point to remove the security strip from the pocket, and pushing the blister layer through the lidding layer of the blister cavity to force the lidding layer to rupture and push the perforated-portion of the exterior layer away there from to dislodges the pharmaceutical composition from the card.

* * * * *